US005743030A

United States Patent [19]

Sirr

[11] Patent Number: 5,743,030

[45] Date of Patent: Apr. 28, 1998

[54] LOADER WITH SCREENING DEVICE

[76] Inventor: Chester Lea Sirr, S5A, C21, RR#1, Lumby, British Columbia, Canada, V0E 2G0

[21] Appl. No.: 619,955

[22] Filed: Mar. 20, 1996

[51] Int. Cl.[6] ..... E02F 03/96

[52] U.S. Cl. ..... 37/406; 37/142.5; 37/407; 37/444; 209/421

[58] Field of Search ..... 37/403, 406, 444, 37/407, 405, 142.5; 414/723, 724, 722; 172/254; 171/132; 209/420

[56] References Cited

U.S. PATENT DOCUMENTS

| | | | |
|---|---|---|---|
| 2,717,704 | 9/1955 | Pilch | 37/406 X |
| 3,003,265 | 10/1961 | Lutjens | 37/444 |
| 3,072,257 | 1/1963 | Hockenberry . | |
| 3,375,595 | 4/1968 | Beltrami | 37/406 |
| 3,461,968 | 8/1969 | Longley | 171/132 |
| 3,581,924 | 6/1971 | Marz | 37/406 X |
| 3,595,416 | 7/1971 | Perrotti | 37/406 X |
| 3,765,490 | 10/1973 | Logue | 37/444 X |
| 3,767,070 | 10/1973 | Arnold | 37/406 |
| 3,854,608 | 12/1974 | Arnold | 37/406 X |
| 3,915,501 | 10/1975 | Cobb et al. | 37/403 X |
| 4,805,703 | 2/1989 | Carlsson | 37/444 X |
| 5,271,170 | 12/1993 | Mieger | 37/406 |
| 5,311,684 | 5/1994 | Van Dalfsen . | |
| 5,398,430 | 3/1995 | Scott et al. | 37/403 X |
| 5,405,092 | 4/1995 | Jomninen . | |
| 5,544,435 | 8/1996 | Somero | 37/403 X |

*Primary Examiner*—Terry Lee Melius
*Assistant Examiner*—Victor Batson
*Attorney, Agent, or Firm*—C. A. Rowley

[57] ABSTRACT

A loader such as a front end loader is provided with dam shell type bucket having a blade section, and collecting section pivoted thereon. The collecting section has a separating section having a separating surface curved on an are centered on pivotal axis of the collecting section and positioned relative to the leading edge of the blade section so that it tends to wipe clean the separating surface as it passes thereby when the relevant bucket sections are relatively pivoted from a screening position to a closed position. When the clam shell is in the screening position, the separating section forms at least a portion of the bottom of the bucket. A sifting screen for sifting finer material may also be provided as a dam at the free end of the collecting section.

16 Claims, 5 Drawing Sheets

LOADER WITH SCREENING DEVICE

FIELD OF INVENTION

The present invention relates to a particle size separating bucket, more particularly, the present invention relates to a self-cleaning, particle size separating clam shell type loading bucket for an earth moving machine.

BACKGROUND OF THE INVENTION

The requirement for screening aggregate or the like on the site of a construction operation normally requires the use of a separate screen of one form or another, so that to achieve the required result, a front end loader, backhoe or other earth moving type equipment is used to load the screen and eventually pick-up the screened (separated) material and/or the rejects and move them to their place of utility.

Many sites cannot economically justify the use of several pieces of equipment and attempts have been made to provide a loader equipment that functions, not just as an earth mover but also as a particle screening or separating device.

U.S. Pat. No. 3,072,257 issued Jan. 8, 1963 to Hawkenberry describes a combined gravel collecting and straining system formed in the bucket of an earth mover having a blade, a collecting section and a screen section. The screen section forms part of the floor of the bucket adjacent to the free end of the collecting section, i.e. projecting from the collecting section in the direction away from the blade. In this system, the blade and collecting section combine to pick up the gravel or the like to be screened and then the bucket is oriented to move the material away from the blade section against a dam at the free or leading end of the screening section and onto the screening section. Shaking or otherwise moving the bucket sifts the finer material through the screen. A suitable barricade or dam must be provided at the free end of the extended bucket to prevent the material from simply sliding off the free end of the screen without being screened.

With this system if the screen dogs, there is no effective positive way to clean it other than manually. The bucket may be dumped, but the material may be lodged in the screen and not fall off.

Two recent U.S. Pat. Nos. 5,311,684 issued May 17, 1994 to Dalfsen and 5,405,092 issued Apr. 11, 1995 to Jonninen, describe systems for scooping and crushing using live elements that are rotated within the scooping element to crush or reduce the particle size before the particles are released. These devices are quite complicated and generally require a dedicated bucket system that is only suitable for use for this purpose.

BRIEF DESCRIPTION OF THE PRESENT INVENTION

It is an object of the present invention to provide a bucket for earth moving equipment which includes a self-cleaning particle size separation device.

Broadly, the present invention relates to a bucket for earth moving equipment comprising a blade section having a lower loading edge, a collecting section pivotably connected to said blade section for movement about a normally horizontal axis, said axis being spaced above said leading edge and said collecting section being positioned in from of said blade section and having a digging edge at its leading end and a trailing edge at its trailing end, said trailing edge being adjacent to and being in close proximity to said leading edge when said bucket is in a closed position and means to pivot said collecting section relative to said blade section around said rotational axis to rotate said collecting section between said closed position and a fully open position with said leading edge and said trailing edge spaced apart characterized in that:

An annual separating section is connected to and projects rearwardly from said collecting section, said separating section having a radius from said axis of rotation substantially equal to the radial distance between said leading edge of said blade section and said axis of rotation, said separating section being on the side of said leading edge of said blade remote from said axis of rotation when said bucket is in closed position substantially radially exiting holes through said separating section, said separating section forming the bottom of said bucket between said leading and trailing edges when said trailing edge is spaced from said leading edge and said bucket is in a partially open screening position, thereby material may be separated through said holes in said separation section.

Preferably, said separating section will include axially spaced tines extending circumferentially of said bucket from said collecting section, said tines supporting a screening plate with said holes in said screening plate opening between said tines.

Preferably, each of said holes will have its end positioned adjacent to said collecting section, sloping in a direction radially inward and circumferentially toward said collecting section so that relative movement of said leading edge of said blade along the adjacent surface of said separator section causes material to be moved from said slots thereby to clean said screening section.

Preferably, said holes are elongated slots having their longitudinal axis extending substantially circumferentially as a part of a right cylinder relative to said axis of rotation.

If desired, a screening section may be provided adjacent to said leading edge of said collecting section, said screening screening section in operative closed position extending upward from a floor or said collecting section to from a dam damming the free end of said collecting section, said screening section including a screen and means for moving said screen relative to said bucket in a sifting movement.

Preferably, means will be provided to move said screening section between said operative closed position and an open position wherein said screening section does not obstruct said free end of said collecting section adjacent to said floor.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
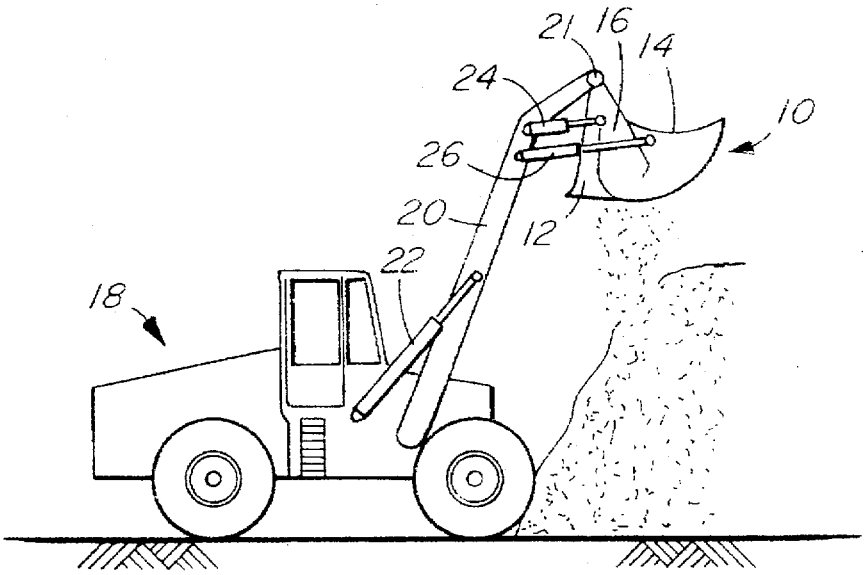
FIG. 1 is a schematic illustration of a earth mover incorporating the present invention.

In the embodiment shown in FIG. 1, the bucket 10 of the present invention is composed of three parts, namely, a blade section 12, a collecting section 14 and a separating section 16, bolted or otherwise secured to the collecting section 14 and projecting rearward (towards the vehicle 18) therefrom. The sections 14 and 16 are moved together as a unit. If the separating section 16 is not required, it may be removed and the bucket used in the conventional manner without the separating section 16.

The bucket 10 may be mounted on any suitable moving device, such as the vehicle 18 and in a conventional manner is supported from the vehicle 18 via an arm or arms 20 which are moved relative to the vehicle 18 via a hydraulic cylinder (s) or the like 22. Generally, the bucket 10 is pivotably mounted at the free end of the arm(s) 20 via a pivot connection 21 to the blade section 12. The orientation of the bucket 10 is regulated relative to the arm 20 by a suitable hydraulic cylinder 26 while orientation of the collecting section relative to the blade section 12 is controlled via a suitable hydraulic cylinder or the like 24.

Any conventional arrangement of hydraulic cylinders for control of the movement of the bucket i.e. blade 12 and collector sections 14 which in the illustrated arrangement is a clam shell type bucket may be used.

Figure 5:
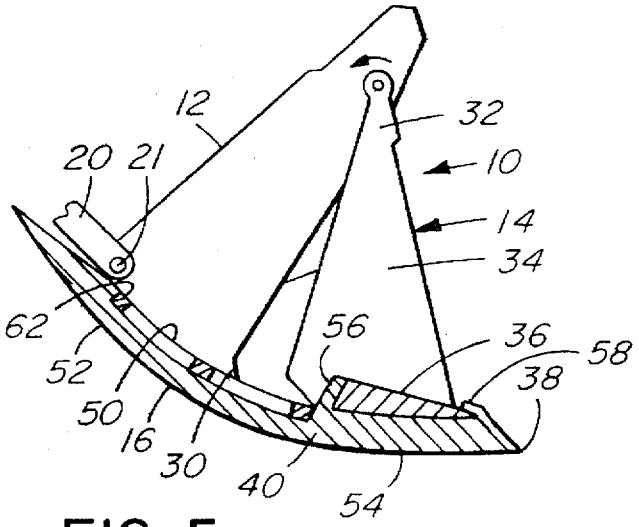
FIG. 5 is a section through a bucket constructed in accordance with the present invention showing the bucket in closed position with the leading cutting edge of the collecting section in position to dig or scrape.
Figure 6:
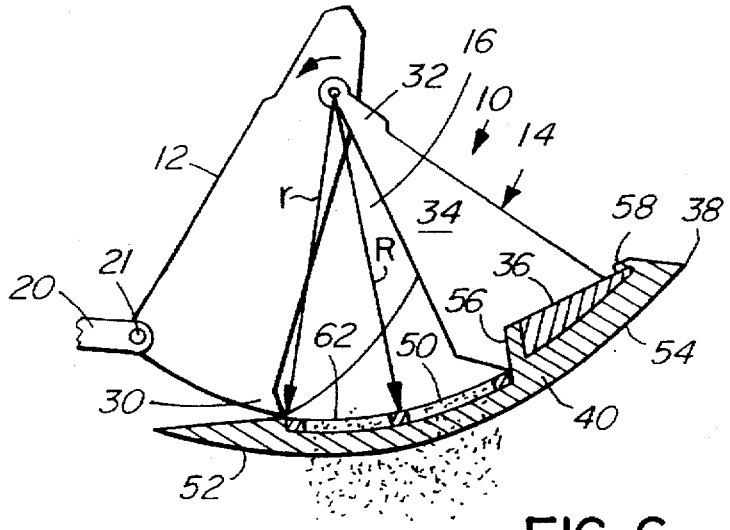
FIG. 6 shows the bucket in a partially open, separating or screening position with separation section of the bucket forming the bottom of the bucket.
Figure 7:
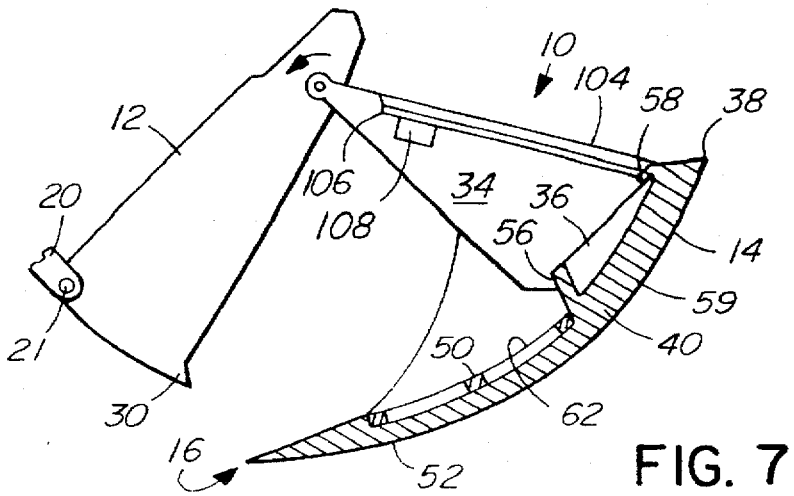
FIG. 7 is a view with the bucket in fully open position, i.e. with the separation section spaced from the blade section to provide an opening into which material may be trapped and showing a screen forming dam at the leading or free end of the collecting section.

Referring to FIGS. 5, 6 and 7, general construction of the blade section 12, collector's section 14 and separating section 16 is illustrated.

The blade section 12 is provided with lower leading edge 30 that as will be described hereinbelow, in addition to its normal function also functions to clean the screening section 16.

Figure 9:
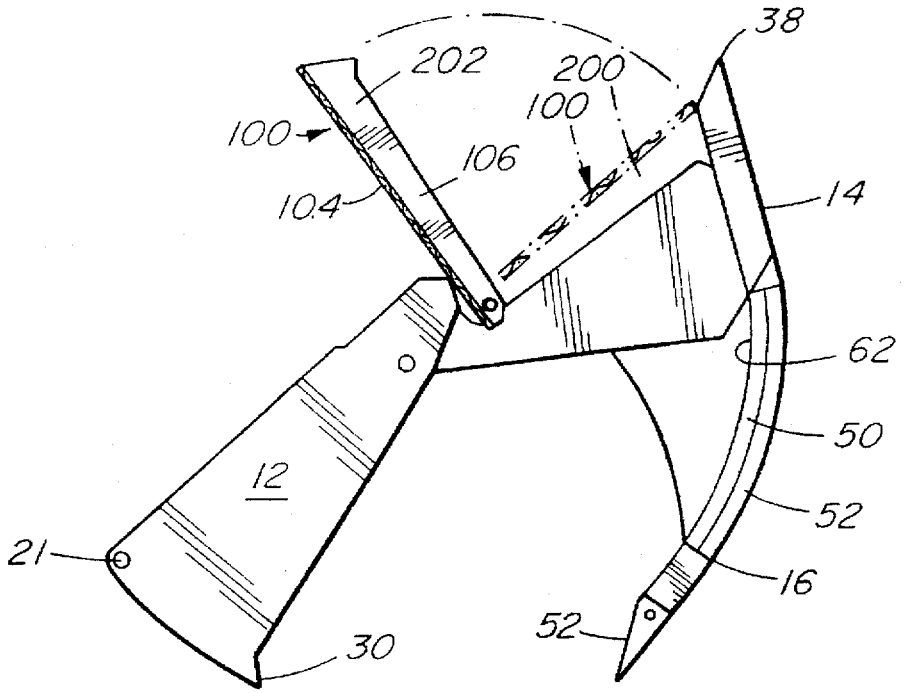
FIG. 9 is a side view with parts omitted showing the bucket in fully open position.

The collecting section 14 is pivotably mounted onto the blade 12 via the pivot pin or shaft 32 so that the collecting section 14 pivots around the pivotal axis of the pin 32 as indicated by the arrow to move the collecting section 14 between the various operating positions including a substantially closed position shown in FIG. 5, the partially open screening position shown in FIG. 6, a first fully open position in FIG. 7 and a second fully open position wherein the sifting screen 100 (to be described below) is also in open or inoperative position in FIG. 9.

The collecting section 14 has a pair of axial end wall 34, only one shown, one at each axial end of the collecting section 14. Interconnecting the bottom of the walls 34 is a bottom plate member 36 having a cutting or digging edge 38 at its leading end (remote from the vehicle 18) and a trailing or dosing edge 40 at its rearward or trailing end adjacent to the blade section 12.

The screening section 16 is formed by a screening or separating plate 50 supported on a plurality of circumferentially extending axially spaced tines or forks 52, preferably these tines or forks 52 extend from a bottom panel 54 that is positioned in face to face relationship with the outer face of the bottom plate 36 of the collecting section 14. The panel 54 is provided with a suitable clamping mechanism to hold the separating section 16 to the collecting section 14. In the illustrated arrangement, a flange 56 cooperates with the trailing end 40 of the bottom plate 36 and a second flange 58 overlaps the leading edge 38 of the plate 36 so that the bottom plate 36 is trapped between the flanges 56 and 58 and is clamped into position, for example, by bolting of the flanges 56 and 58 to the plate 36 or using the flanges to clamp the section 16 to the section 14. Clamping flanges have been shown, it will be apparent that any other suitable system for connecting the sections 14 and 16 may be used, for example, simply bolting the panel or the like 54 to the bottom 36 may be used or if a permanent installation is to be used, these elements may simply be welded together. In a permanent arrangement as opposed to the dismountable system shown the bottom plate 36 itself would likely be provided with tines 52 to support the screening or separation plate 50.

Figure 2:
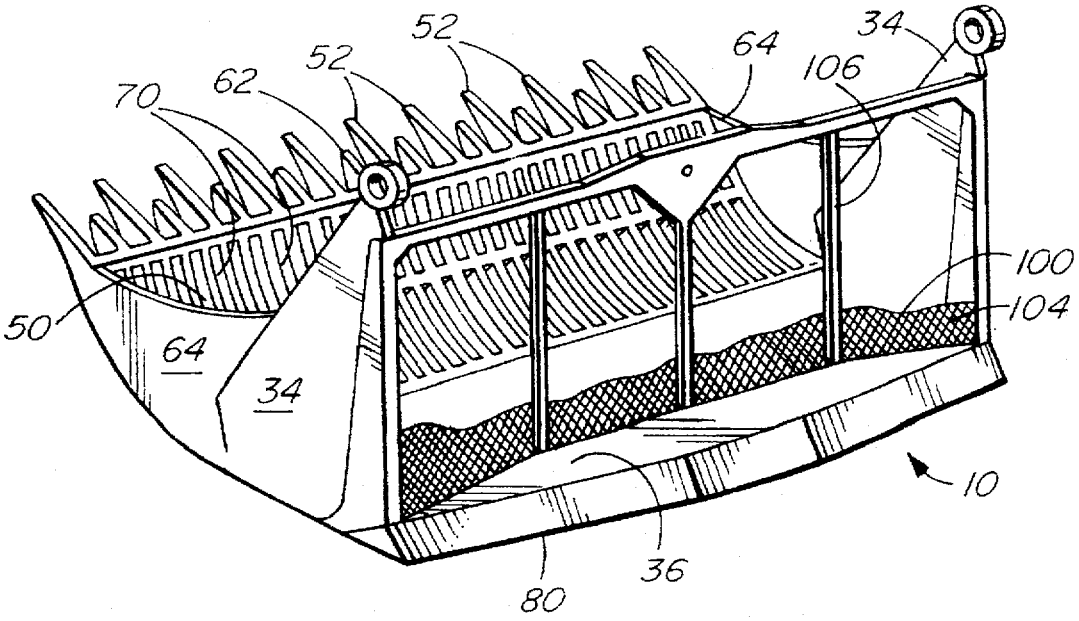
FIG. 2 is a isometric schematic illustration of the bucket with a separating section applied to the end of the collecting section adjacent to the blade and further showing a screening section at the leading (free) end of the collecting section of the bucket.

Separation plate 50 may be secured in position by suitable means such as clamping flanges or bolts or the like 60 which have been schematically shown in FIG. 2 as extending through the plate 50 and screwed into the tines 52. The heads of these bolts 60 will preferably be substantially flush with the inner surface 62 of the plate 50.

A pair of end walls 64 are provided, positioned one at each axial end of the section 16 and close off the axial ends of the section 16. These wails 64 are positioned outside of the walls 34 of the collecting section 14 and of the blade section 12.

Figure 3:
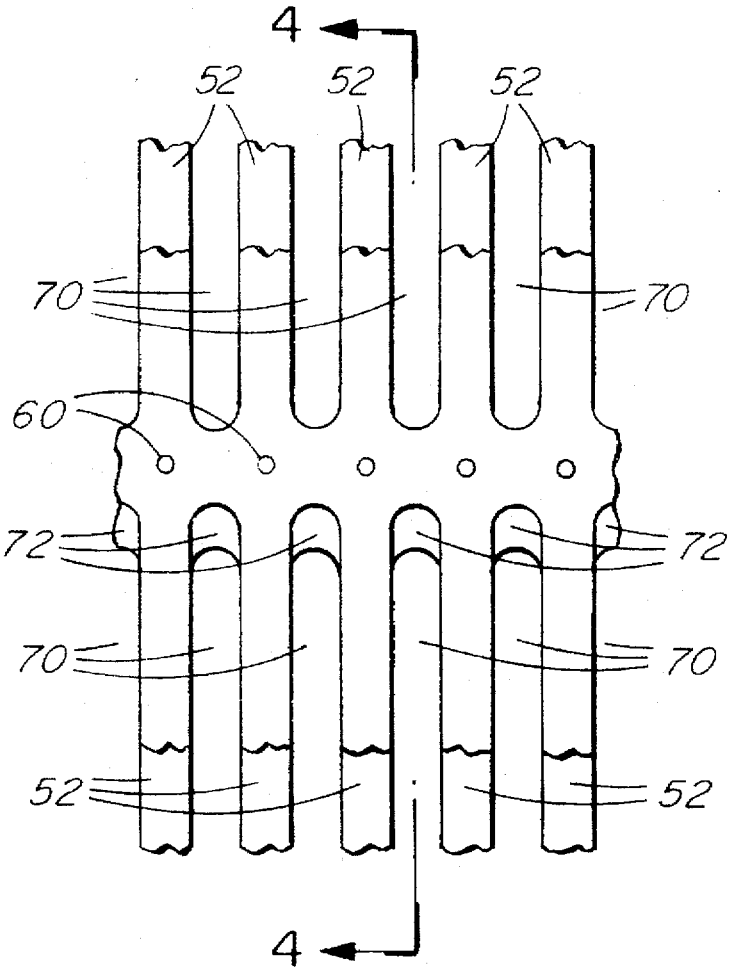
FIG. 3 is a partial plan view looking from inside the bucket at the separating section with parts omitted to show the underlining tines.
Figure 4:
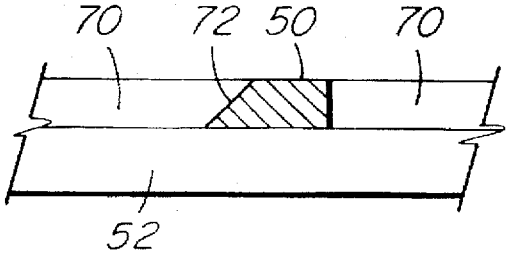
FIG. 4 is a section along the line 4—4 of FIG. 3 and showing the leading edge of the blade section in position for cleaning the separating section.

The screen plate 50 is provided with a plurality of elongated holes 70 arranged in a pattern and extending through the plate 50 with the holes 70 located so that they open between the tines 52 (see FIG. 2, 3 and 4). Preferably, these holes 70 are elongated holes having a longitudinal axis extending substantially circumferentially relative to the plate 50 at least the inner face 62 of which is curved on a radius R (see FIGS. 6, 7 and 10) from the axis of the pin 32 slightly longer than the radius r of the leading edge 30 relative to the axis of rotation round pin 32 so that the surface 62 just clears the leading edge 30 when the collecting section and separating section 14 and 16 respectively are pivoted on axis 32 relative to the section 12 between the positions shown in FIGS. 5 and 6 so that the leading edge 30 tends to scrape along the inner surface 62 of the plate 50 (see in particular FIGS. 5, 6, and 10).

Preferably, the leading edge of each of the slots 70, i.e. the ends of the slots 70 closest to the collecting section 14 are each sloped as indicated at 72 in FIGS. 3 and 4, radially inward i.e. upward toward the axis 32 and forward so that the relative movement of the edge 30 and the slots 70 when moving from the position shown in FIG. 6 to the position shown in FIG. 5 tends to move material up the slope 72 and out of the slot and thereby dear the slots 70 i.e. a cleaning action takes place when the sections 14 and 16 are moved relative to the blade section 12 from the partially open screening position (FIG. 6) to the closed position (FIG. 5).

In the arrangement shown in FIG. 2, the leading edge 76 of the blade member 54 of the sifting section 16 may be provided with a cutting edge as shown by the dotted lines 80 to act as the cutting edge in place of the free edge 38 when the sifting means is in place, or alternatively may be provided with spikes or the like (not shown) to facilitate breaking or digging action at the front end of the collecting section 14.

Figure 10:
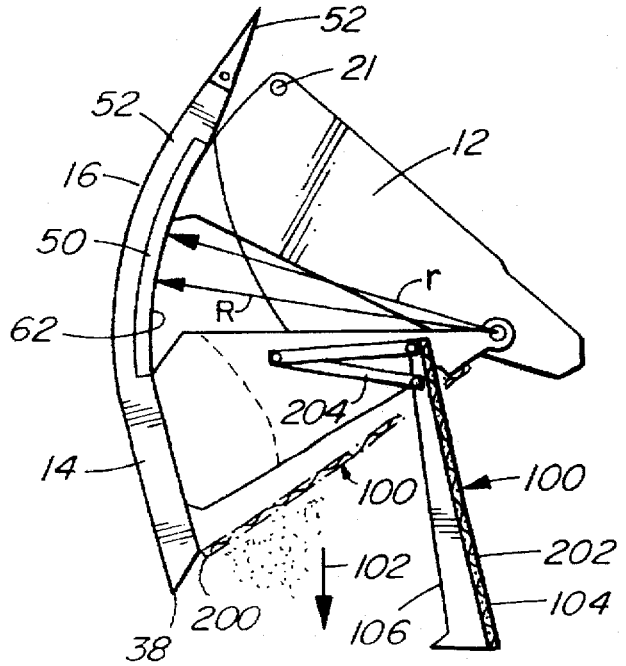
FIG. 10 shows the bucket oriented for sifting through the sifting section.

Applicant has found that it is sometimes desirable to mount a vibrating or oscillating sifting screen such as the screen 100 along the leading end of the collecting section 14 to extend between the walls 34 adjacent to the bottom 36 (see FIG. 2, 7 8, 9 or 10) so that material may be screened by properly orienting the bucket 10 so that the screen 100 faces down as shown in FIG. 10 and material is fed from inside of the collecting section 14 outward in the direction of the arrow 102.

Figure 8:
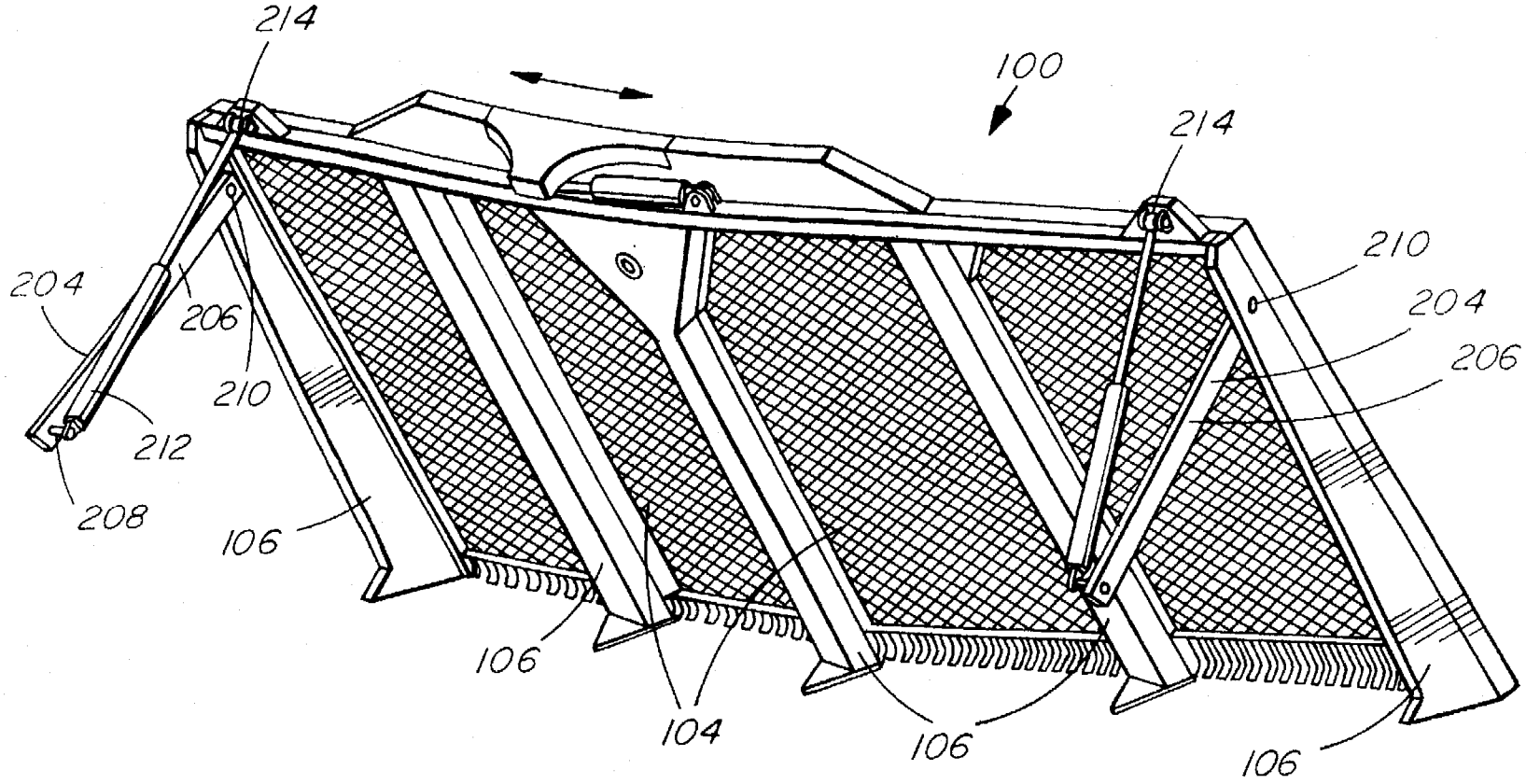
FIG. 8 is an isometric view with parts omitted showing the sifting section.

Preferably, as schematically indicated in FIGS. 2, 7 and 8 the screen 100 is formed by a screen section 104 mounted on a frame 106 which in turns mount a power element (motor or the like) 108 (shown in FIG. 7 only) that applies the vibratory motion to the screen section 104 to move the screen 104 section relative to the frame 106.

The screen 100 is removably mounted on the bucket 10. When mounted on the bucket 10 the screen 100 is moveable relative to the collecting section 14 between a closed screening position shown in dotted lines in FIGS. 9 and 10 and an open position 202 shown in solid lines in FIGS. 9 and 10. This movement is attained by any suitable system such as the linkage system 204 shown in FIG. 10 and in more detail in FIG. 8.

As shown in FIG. 8 the linkage 204 preferably includes a bar 206 secured via pin 208 to the section 14 and pivotably connected to the screen section 100 via pivot pin 210. A suitable hydraulic cylinder 212 connected at one end to the pin 208 and at its opposite end as indicated at 214 to the screening section 100 pivots the screen 100 relative to the section 14 on pin 210 to move the screen 100 between its open and closed (operative) positions.

The separating section 16 is primarily intended for passing particles having sizes in the order of 2 inches, i.e. the width of the slot 70 would likely be approximately 2 inches whereas the screen 100 is intended to sift to separate much finer material.

Having described the invention, modifications will be evident to those skilled in the art without departing from the scope of the invention as defined in the appended claims.

We claim:

1. A bucket for earth moving equipment comprising a blade section having a lower leading edge, a collecting section pivotably connected to said blade section for movement about a normally horizontal axis of rotation, said axis of rotation being spaced from said lower leading edge and said collecting section being positioned in front of said blade section and having a leading end and a trailing end, a digging edge at said leading end and a trailing edge at said trailing end, said trading edge being adjacent to and being in close proximity to said leading edge when said bucket is in a closed position and means to pivot said collecting section relative to said blade section around said rotational axis to rotate said collecting section between said closed position and a fully open position with said leading edge and said trailing edge spaced apart characterized in that:

an annual separating section is connected to and projects rearwardly from said collecting section, said separating section having an inner surface with a radius measured from said axis of rotation substantially equal to the radial distance between said leading edge of said blade section and said axis of rotation, said separating section being on the side of said leading edge of said blade section remote from said collecting section when said bucket is in closed position, substantially radially exiting holes through said separating section, said separating section forming the bottom of said bucket between said leading and trailing edges when said trailing edge is spaced from said leading edge and said bucket is in a partially open screening position, thereby material may be separated through said holes in said separation section.

2. A bucket as defined in claim 1 wherein said separating section includes axially spaced tines extending circumferentially of said bucket rearward from said collecting section, said tines supporting a screening plate with holes opening between said tines.

3. A bucket as defined in claim 1 wherein each of said holes is in the form of a slot and each said slot has its end positioned adjacent to said collecting section sloping in a direction radially inward and circumferentially toward said collecting section so that relative movement of said leading edge of said blade along said separating section causes material to be moved from said slots thereby to clean said separating section.

4. A bucket as defined in claim 2 wherein each of said holes is in the form of a slot and each said slot has its end positioned adjacent to said collecting section sloping in a direction radially inward and circumferentially toward said collecting section so that relative movement of said leading edge of said blade along said separating section causes material to be moved from said slots thereby to clean said separating section.

5. A bucket as defined in claim 1 wherein said holes are elongated slots having their longitudinal axis extending substantially circumferentially as a part of a right cylinder relative to said axis of rotation.

6. A bucket as defined in claim 2 wherein said holes are elongated slots having their longitudinal axis extending substantially circumferentially as a part of a right cylinder relative to said axis of rotation.

7. A bucket as defined in claim 3 wherein said holes are elongated slots having their longitudinal axis extending substantially circumferentially as a part of a right cylinder relative to said axis of rotation.

8. A bucket as defined in claim 4 wherein said holes are elongated slots having their longitudinal axis extending substantially circumferentially as a part of a right cylinder relative to said axis of rotation.

9. A bucket as defined in claim 1 further comprising a screening dam adjacent to said leading cutting edge of said collecting section, said screening dam including a screen and means for moving said screen relative to said bucket in a vibratory movement.

10. A bucket as defined in claim 2 further comprising a screening dam adjacent to said leading cutting edge of said collecting section, said screening dam including a screen and means for moving said screen relative to said bucket in a vibratory movement.

11. A bucket as defined in claim 3 further comprising a screening dam adjacent to said leading cutting edge of said collecting section, said screening dam including a screen and means for moving said screen relative to said bucket in a vibratory movement.

12. A bucket as defined in claim 4 further comprising a screening dam adjacent to said leading cutting edge of said collecting section, said screening dam including a screen and means for moving said screen relative to said bucket in a vibratory movement.

13. A bucket as defined in claim 5 further comprising a screening dam adjacent to said leading cutting edge of said collecting section, said screening dam including a screen and means for moving said screen relative to said bucket in a vibratory movement.

14. A bucket as defined in claim 6 further comprising a screening dam adjacent to said leading cutting edge of said collecting section, said screening dam including a screen and means for moving said screen relative to said bucket in a vibratory movement.

15. A bucket as defined in claim 7 further comprising a screening dam adjacent to said leading cutting edge of said collecting section, said screening dam including a screen and means for moving said screen relative to said bucket in a vibratory movement.

16. A bucket as defined in claim 8 further comprising a screening dam adjacent to said leading cutting edge of said collecting section, said screening dam including a screen and means for moving said screen relative to said bucket in a vibratory movement.

* * * * *